US010244914B2

(12) United States Patent
Tchakarov

(10) Patent No.: US 10,244,914 B2
(45) Date of Patent: Apr. 2, 2019

(54) POLISHING OR GRINDING PAD ASSEMBLY

(71) Applicant: Diamond Tool Supply, Inc., Monroe, MI (US)

(72) Inventor: Tchavdar V. Tchakarov, Monroe, MI (US)

(73) Assignee: Husqvarna Construction Products North America, Inc., Charlotte, NC (US)

( * ) Notice: Subject to any disclaimer, the term of this patent is extended or adjusted under 35 U.S.C. 154(b) by 0 days.

(21) Appl. No.: 15/927,560

(22) Filed: Mar. 21, 2018

(65) Prior Publication Data

US 2018/0206690 A1 Jul. 26, 2018

Related U.S. Application Data

(63) Continuation of application No. PCT/US2016/053355, filed on Sep. 23, 2016.
(Continued)

(51) Int. Cl.
*B24B 7/18* (2006.01)
*B24B 41/047* (2006.01)
(Continued)

(52) U.S. Cl.
CPC ..... *A47L 11/4038* (2013.01); *A47L 11/164* (2013.01); *B24B 7/18* (2013.01);
(Continued)

(58) Field of Classification Search
CPC ..... B24B 7/18; B24B 7/186; B24B 41/047; B24D 13/14
(Continued)

(56) References Cited

U.S. PATENT DOCUMENTS 2,225,193 A 12/1940 Benner et al.
2,425,368 A * 8/1947 Doermann ..... B24D 7/16 451/548
(Continued)

FOREIGN PATENT DOCUMENTS

CA 159666 7/2015
CA 162792 7/2015
(Continued)

OTHER PUBLICATIONS

"Diamond Tools for Construction Stone," EHWA Diamond Ind. Co. Ltd. Catalogue, Published 2016, 60 pages.
(Continued)

*Primary Examiner* — Eileen P Morgan
(74) *Attorney, Agent, or Firm* — Harness, Dickey & Pierce, PLC

(57) ABSTRACT

A floor polishing or grinding pad assembly is provided. In one aspect, a polishing or grinding pad assembly employs a fibrous pad, a reinforcement layer or ring, and multiple floor-contacting disks. In another aspect, the reinforcement layer includes a central hole through which the fibrous pad is accessible and the fibrous pad at the hole has a linear dimension (x) greater than a linear dimension (y) of one side of the adjacent reinforcement layer. In yet another aspect, at least one of the floor-contacting disks has an angle (α) offset from that of a base surface of the disk, the fibrous pad and/or the reinforcement layer. A further aspect employs a smaller set of disks alternating between and/or offset from a larger set of the disks. In another aspect, the reinforcement layer includes a wavy or undulating internal edge shape.

30 Claims, 14 Drawing Sheets

Related U.S. Application Data

(60) Provisional application No. 62/232,123, filed on Sep. 24, 2015.

(51) Int. Cl.

| | |
|---|---|
| ***B24D 13/14*** | (2006.01) |
| ***A47L 11/40*** | (2006.01) |
| ***B24D 7/08*** | (2006.01) |
| ***B24D 11/00*** | (2006.01) |
| ***B24D 18/00*** | (2006.01) |
| ***A47L 11/164*** | (2006.01) |
| ***B24B 7/22*** | (2006.01) |
| ***B24D 7/06*** | (2006.01) |

(52) U.S. Cl.
CPC ..... *B24B 7/186* (2013.01); *B24B 7/22* (2013.01); *B24B 41/047* (2013.01); *B24B 41/0475* (2013.01); *B24D 7/066* (2013.01); *B24D 7/08* (2013.01); *B24D 11/00* (2013.01); *B24D 13/14* (2013.01); *B24D 18/0072* (2013.01)

(58) Field of Classification Search
USPC ..... 451/353
See application file for complete search history.

(56) References Cited

U.S. PATENT DOCUMENTS

| | | | | | |
|---|---|---|---|---|---|
| 3,121,982 | A * | 2/1964 | Miller | B24D 7/06 | 451/548 |
| 3,464,166 | A * | 9/1969 | Bouvier | B24D 13/14 | 451/548 |
| 3,517,466 | A * | 6/1970 | Bouvier | B24D 13/14 | 451/490 |
| 3,823,516 | A | 7/1974 | Christian | | |
| 3,934,377 | A | 1/1976 | Tertinek | | |
| 4,271,557 | A | 6/1981 | Caron | | |
| 5,054,245 | A | 10/1991 | Coty | | |
| 5,076,023 | A * | 12/1991 | Saguchi | B24D 7/066 | 451/540 |
| 5,174,795 | A | 12/1992 | Wiand | | |
| 5,247,765 | A * | 9/1993 | Quintana | B24D 7/063 | 451/548 |
| 5,567,503 | A * | 10/1996 | Sexton | B24B 7/22 | 428/137 |
| 5,586,930 | A * | 12/1996 | Hayashi | B24B 7/22 | 451/548 |
| 5,605,493 | A | 2/1997 | Donatelli et al. | | |
| 5,607,345 | A | 3/1997 | Barry et al. | | |
| 5,683,143 | A | 11/1997 | Peterson et al. | | |
| 5,782,682 | A * | 7/1998 | Han | B24B 7/22 | 451/548 |
| 5,970,559 | A | 10/1999 | Christy | | |
| 6,196,911 | B1 * | 3/2001 | Preston | B24D 18/00 | 451/548 |
| 6,234,886 | B1 | 5/2001 | Rivard et al. | | |
| 6,261,164 | B1 | 7/2001 | Rivard et al. | | |
| 6,299,522 | B1 | 10/2001 | Lee | | |
| 6,371,842 | B1 | 4/2002 | Romero | | |
| 6,739,963 | B1 | 5/2004 | Mas Garcia | | |
| 7,059,801 | B2 | 6/2006 | Snyder et al. | | |
| 7,104,739 | B2 * | 9/2006 | Lagler | B27C 1/005 | 299/41.1 |
| 7,147,548 | B1 * | 12/2006 | Mehrabi | B24B 7/186 | 451/323 |
| 7,192,339 | B1 * | 3/2007 | Harding | B24B 7/186 | 451/350 |
| 7,204,745 | B2 | 4/2007 | Thysell | | |
| D612,874 | S * | 3/2010 | Nilsson | D15/138 | |
| 7,670,208 | B2 * | 3/2010 | Thysell | B24B 7/186 | 125/3 |
| 7,690,970 | B2 | 4/2010 | Palushaj | | |
| 7,744,447 | B2 * | 6/2010 | Kodani | B24D 7/06 | 451/259 |
| 7,815,393 | B2 | 10/2010 | Snyder et al. | | |
| 7,997,960 | B2 | 8/2011 | Williams, Sr. | | |
| 8,147,297 | B2 * | 4/2012 | Hamm | B24B 41/047 | 451/270 |
| 8,176,909 | B2 | 5/2012 | Ilgner | | |
| 8,251,780 | B2 | 8/2012 | Ward et al. | | |
| 8,272,924 | B2 | 9/2012 | Van Eijden et al. | | |
| 8,464,420 | B2 * | 6/2013 | Ye | B24B 7/186 | 29/244 |
| D743,456 | S * | 11/2015 | Shinozaki | D15/126 | |
| 9,174,326 | B2 | 11/2015 | Ahonen | | |
| 9,314,899 | B2 | 4/2016 | Puchegger et al. | | |
| D795,666 | S | 8/2017 | Tchakarov et al. | | |
| 9,925,645 | B2 * | 3/2018 | Song | B24D 7/066 | |
| 2005/0164620 | A1 * | 7/2005 | Amamoto | B23C 5/006 | 451/548 |
| 2005/0172428 | A1 | 8/2005 | Thysell | | |
| 2007/0254568 | A1 * | 11/2007 | Park | B24D 7/066 | 451/548 |
| 2007/0292207 | A1 * | 12/2007 | Reed | B24B 7/186 | 404/112 |
| 2008/0311826 | A1 | 12/2008 | Thysell | | |
| 2009/0190999 | A1 | 7/2009 | Copoulos | | |
| 2009/0191799 | A1 | 7/2009 | Rivard | | |
| 2010/0136889 | A1 | 6/2010 | Kilgren et al. | | |
| 2011/0195644 | A1 | 8/2011 | Gallup et al. | | |
| 2011/0223845 | A1 * | 9/2011 | Van Der Veen | B24B 7/186 | 451/548 |
| 2011/0300784 | A1 | 12/2011 | Tchakarov et al. | | |
| 2012/0270483 | A1 * | 10/2012 | Bae | B24B 7/186 | 451/540 |
| 2013/0225051 | A1 | 8/2013 | Vankouwenberg | | |
| 2013/0324021 | A1 * | 12/2013 | Ryan | B24D 11/00 | 451/529 |
| 2016/0136772 | A1 | 5/2016 | Littlefield et al. | | |
| 2016/0221155 | A1 | 8/2016 | Song et al. | | |
| 2017/0129067 | A1 | 5/2017 | Young | | |
| 2017/0361414 | A1 * | 12/2017 | Tchakarov | B24B 41/047 | |
| 2017/0361423 | A1 * | 12/2017 | Tchakarov | B24D 7/08 | |

FOREIGN PATENT DOCUMENTS

| | | |
|---|---|---|
| CA | 162793 | 7/2015 |
| CA | 162794 | 7/2015 |
| CA | 162795 | 7/2015 |
| CA | 162796 | 7/2015 |
| CA | 162797 | 7/2015 |
| DE | 202015101442 U1 | 5/2015 |
| JP | S56-94267 U | 7/1981 |
| JP | H01117854 U | 8/1989 |
| JP | 2004025401 A | 1/2004 |
| JP | 2004276197 A | 10/2004 |
| JP | 2012232378 A | 11/2012 |
| KR | 100816026 B1 | 3/2008 |
| KR | 100853547 B1 | 8/2008 |

OTHER PUBLICATIONS

Diamond Tool Supply, Inc., "Monroe Floor Polishing Systems," www.diamondtoolsupply.com, published prior to Sep. 24, 2015, 14 pages.

Diamond Tool Supply, Inc., Various polishing and grinding parts, www.diamondtoolsupply.com, published prior to Sep. 24, 2015, 26 pages.

Wagman Metal Products Inc, "Concrete Finishing Tools," www.WagnamMetal.com, published prior to Sep. 14, 2016, 24 pages.

"Confidential/experimental sale from Diamond Tool Supply, Inc. to Wagman Metal Products on Sep. 1, 2016," 2 pages.

* cited by examiner

POLISHING OR GRINDING PAD ASSEMBLY

CROSS-REFERENCE TO RELATED APPLICATIONS

This application is a continuation of International Application No. PCT/US2016/053355, filed on Sep. 23, 2016, which claims priority to U.S. Provisional Application No. 62/232,123, filed on Sep. 24, 2015, both of which are incorporated by reference herein.

BACKGROUND AND SUMMARY

The disclosure relates generally to a pad assembly and more particularly to a floor polishing or grinding pad assembly.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patents and patent publication numbers: 2011/0300784 entitled "Flexible and Interchangeable Multi-Head Floor Polishing Disk Assemby" which was invented by Tchakarov et al. and published on Dec. 8, 2011; U.S. Pat. No. 9,174,326 entitled "Arrangement For Floor Grinding" which issued to Ahonen on Nov. 3, 2015; U.S. Pat. No. 6,234,886 entitled "Multiple Abrasive Assembly and Method" which issued to Rivard et al. on May 22, 2001; U.S. Pat. No. 5,605,493 entitled "Stone Polishing Apparatus and Method" which issued to Donatelli et al. on Feb. 25, 1997; and U.S. Pat. No. 5,054,245 entitled "Combination of Cleaning Pads, Cleaning Pad Mounting Members and a Base Member for a Rotary Cleaning Machine" which issued to Coty on Oct. 8, 1991. All of these patents and the patent publication are incorporated by reference herein.

Notwithstanding, improved floor polishing and grinding performance is desired. Furthermore, some of these prior constructions exhibit uneven wear in use which prematurely destroy the pads or cause inconsistent polishing or grinding.

In accordance with the present invention, a floor polishing or grinding pad assembly is provided. In one aspect, a polishing or grinding pad assembly employs a fibrous pad, a reinforcement layer or ring, and multiple floor-contacting disks. In another aspect, the reinforcement layer includes a central hole through which the fibrous pad is accessible and the fibrous pad at the hole has a linear dimension greater than a linear dimension of one side of the adjacent reinforcement layer. In yet another aspect, at least one of the floor-contacting disks has an angle offset from that of a base surface of the disk, the fibrous pad and/or the reinforcement layer. A further aspect employs a smaller set of disks alternating between and/or offset from a larger set of the disks. In another aspect, the reinforcement layer includes a wavy or undulating internal edge shape. Still another aspect includes different abrasive and/or floor-contacting patterns on the disks. A method of using a fibrous pad employing multiple polishing or grinding disks is also presented.

The present pad assembly is advantageous over traditional devices. For example, some of the disk configurations, such as disk angles and/or offset placement of disks, of the present pad assembly advantageously create more consistent wear characteristics when polishing or grinding, thereby increasing their useful life and consistency of polishing or grinding. These angles cause more even inner and outer wear of the floor-facing side of the pad assembly. Furthermore, the present pad assembly advantageously allows greater floor contact with the fibrous pad within a centralized area generally surrounded by the disks, in various of the present aspects, which is expected to improve polishing or grinding performance. In other configurations of the present pad assembly, the disk patterns, disk quantities, disk-to-disk locations and inner edge shapes of the reinforcement layer may provide improved liquid abrasive flow characteristics during polishing or grinding. The preassembled nature of the fibrous pad, reinforcement ring or layer, and the abrasive disks makes the present pad assembly considerably easier to install on a floor polishing or grinding machine than many prior constructions. Additional advantages and features of the present invention will be readily understood from the following description, claims and appended drawings.

DETAILED DESCRIPTION

Figure 1:
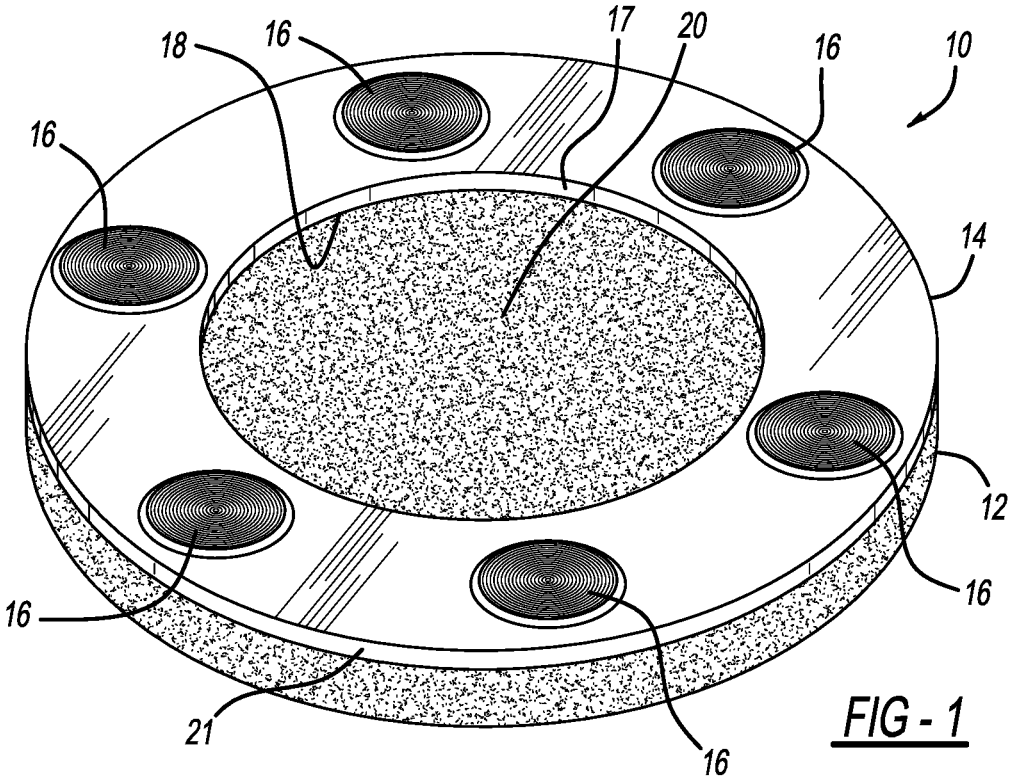
FIG. 1 is a bottom perspective view showing a first embodiment of the pad assembly.

A pad assembly 10 according to one embodiment is shown in FIGS. 1-5. Pad assembly 10 may be used for grinding or polishing composite surfaces, such as concrete. Pad assembly 10 includes a wear-resistant base pad 12, which may be a porous, fibrous, flexible, and deformable material, including natural and/or artificial fibers. Base pad 12 is generally circular, having a diameter and a thickness. Of course, base pad 12 could be made in other sizes.

A reinforcement ring or layer 14 is secured to one side of base pad 12, such as by adhesive. The reinforcement ring 14 is generally annular having a central opening 18 with a diameter (for example, approximately 8 inches). Reinforcement ring 14 may be a rigid rubber or plastic having a thickness greater than zero and up to 0.125 inch. Reinforcement ring or layer 14 reinforces and adds some stiffness and toughness to the outer portion of pad 12, however, ring or layer 14 allows some flexibility to pad assembly 10 so it can flex with and follow any floor imperfections thereby producing uniform floor contact for polishing or grinding.

A circular internal edge 17 of reinforcement ring 14 defines a central opening or hole 18 which exposes a central surface 20 of base pad 12. Central surface 20 of base pad 12 may be impregnated with diamond particles or other abrasive materials. Central surface 20 of the base pad 12 may also be painted a color indicating a quality of the pad assembly 10, such as the coarseness. Base pad 12 and ring 14 preferably have circular peripheral surfaces 19 and 21, respectively.

A plurality of abrasive tools or floor-contacting disks 16 are secured to the outer surface of the reinforcement ring 14. In the example shown, abrasive tools 16 are approximately 2 inch disks of diamond particles in a polymeric resin matrix. In the example shown, six such abrasive tools or disks 16 are secured about the circumference of reinforcement ring 14. Different sizes and different compositions of abrasive tools or disks 16 could be used. Tools or disks 16 are adhesively bonded to ring 14.

Figure 2:
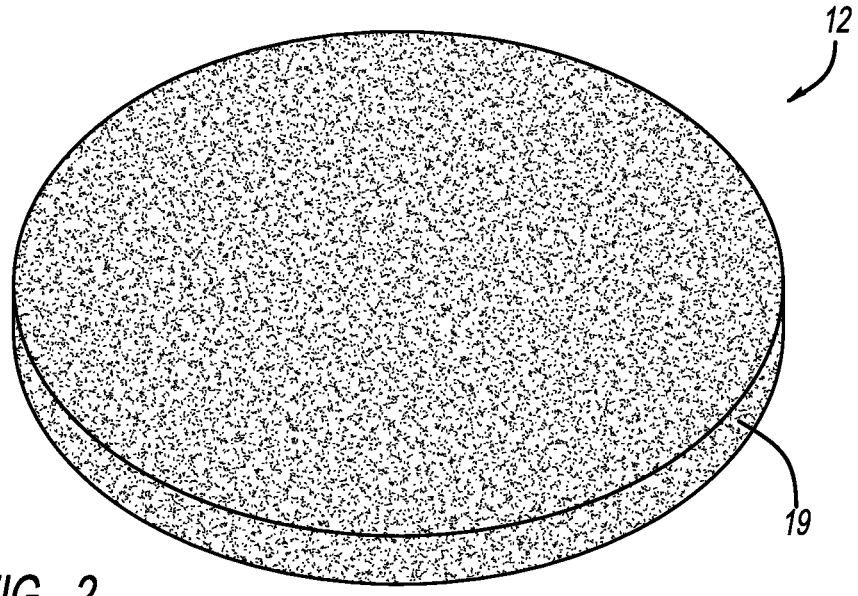
FIG. 2 is a top perspective view showing a fibrous pad employed in all embodiments of the pad assembly.

FIG. 2 shows base pad 12. Again, different base pads 12 could be used, but the example shown is a wear-resistant base pad 12 having a diameter of approximately 14 inches and a thickness of approximately one inch.

Figure 3:
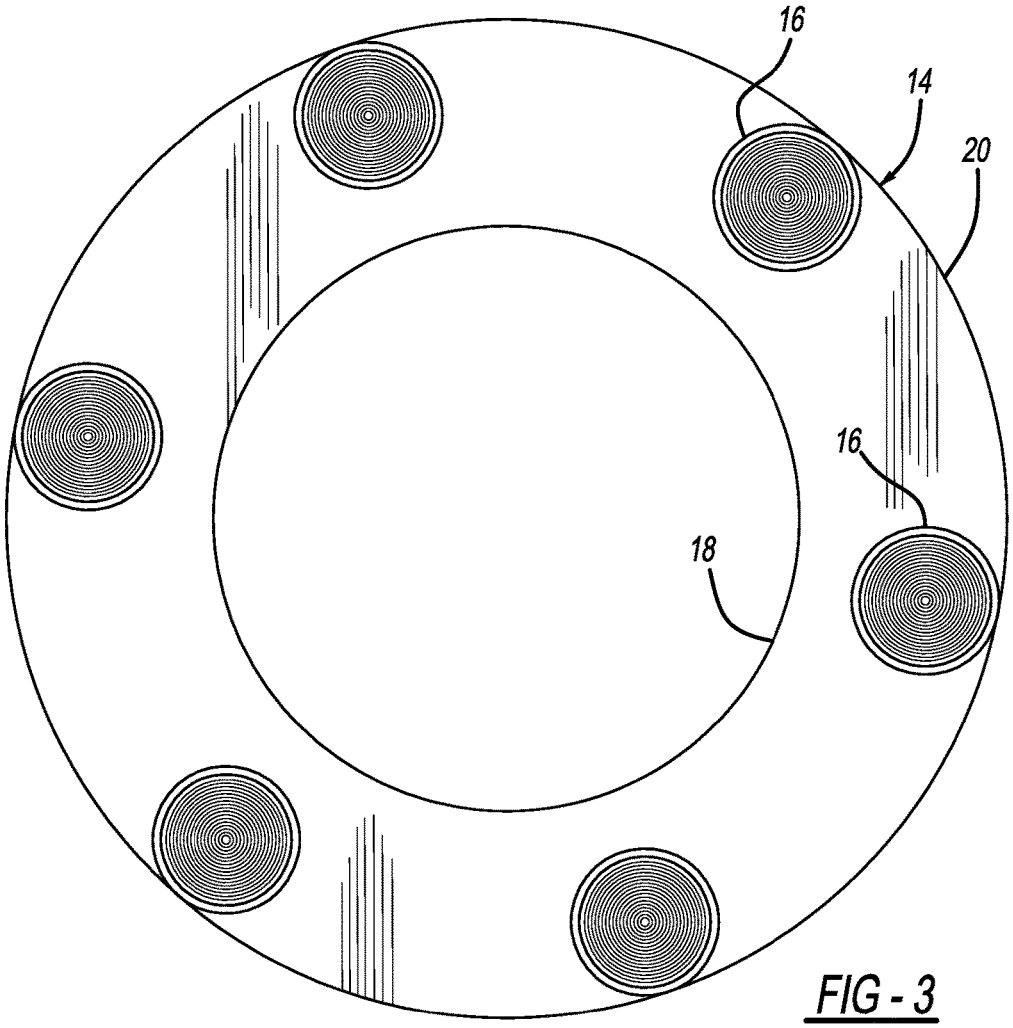
FIG. 3 is a bottom elevational view showing a reinforcement ring layer and abrasive disks employed with the first embodiment pad assembly.
Figure 4:
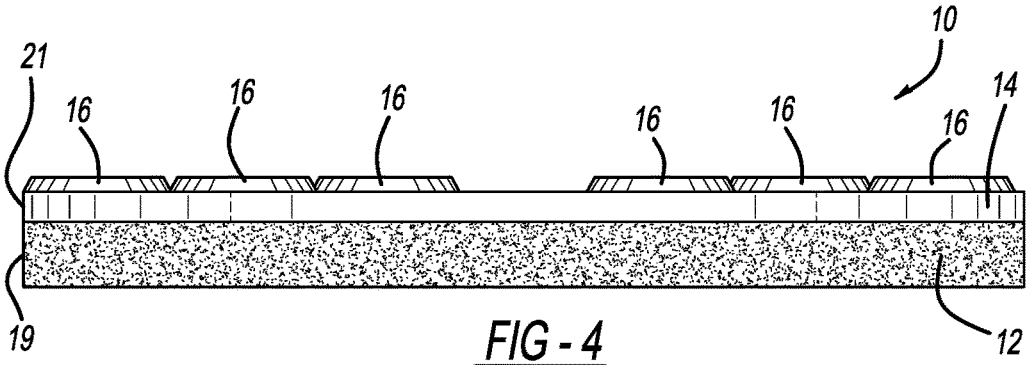
FIG. 4 is a side elevational view showing the first embodiment pad assembly.
Figure 5:
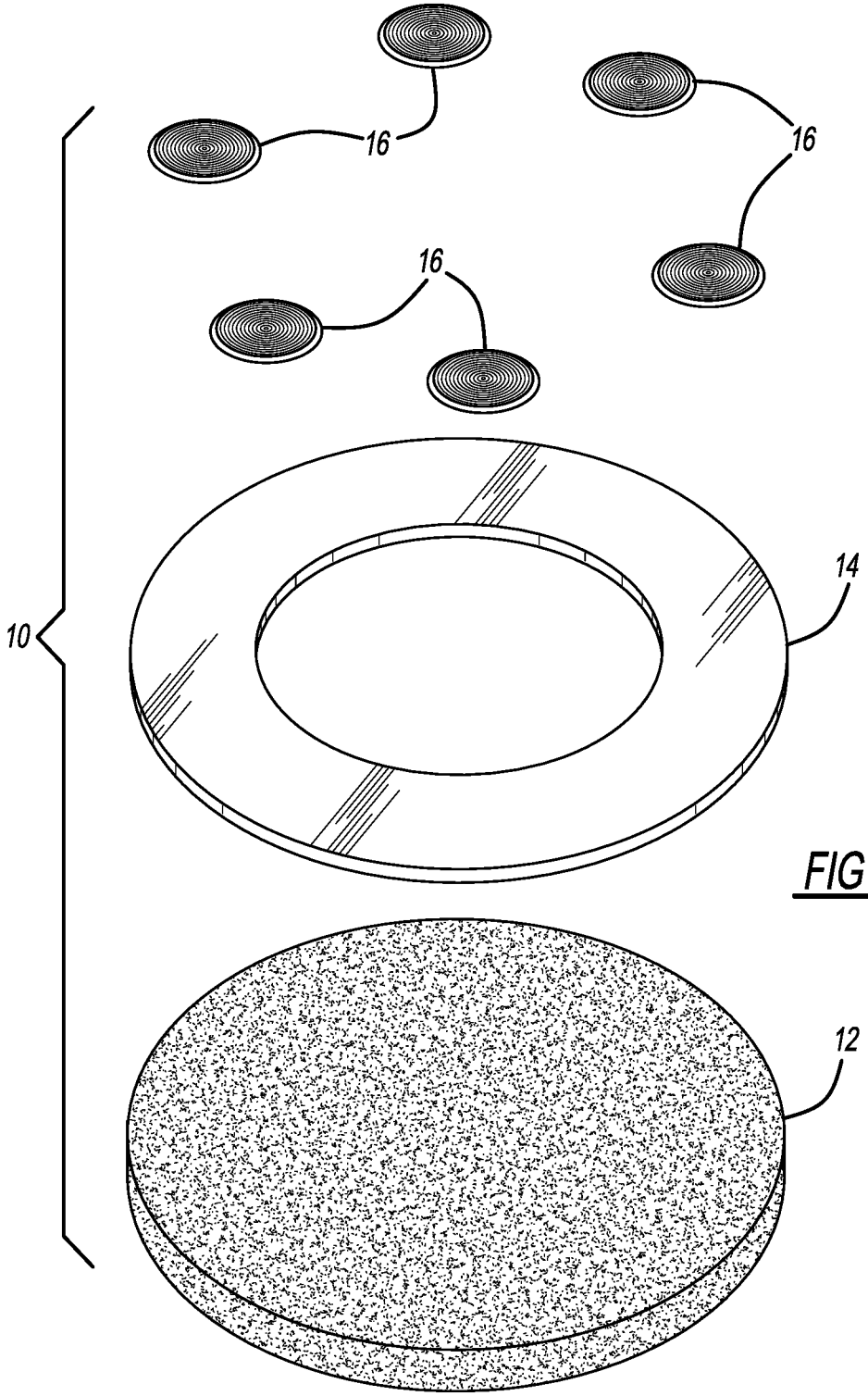
FIG. 5 is an exploded bottom perspective view showing the first embodiment pad assembly.

FIG. 3 is a bottom view of reinforcement ring 14 with the plurality of abrasive tools or disks 16 secured thereto. FIG. 4 is a side view of polishing pad 10 of FIG. 1. As shown, reinforcement ring 14 is secured to base pad 12. The plurality of abrasive tools or disks 16 are secured to reinforcement ring 14. FIG. 5 is an exploded view of polishing pad of FIG. 1, showing base pad 12, reinforcement ring 14 and the plurality of abrasive tools or disks 16.

As shown in FIGS. 6A-6E, many different types of abrasive tools or disks 16 and 16*a-c* could be secured to reinforcement ring 14. As can be viewed in FIG. 6B, tool or disk 16*a* has a floor-contacting and abrasive pattern 30 consisting of multiple concentric circles 32, preferably at least 3 and more preferably 4, intersected by straight radial spokes 34 and 36. Spokes 34 linearly extend from an innermost circle to an outermost and peripheral tapered circle while spokes 36 are radially shorter and linearly extend from an intermediate circle to the peripheral circle. The spokes are equally spaced about the entire disk. Spokes 34 and 36 are aligned with a centerline 41. Circles 32 and spokes 34 and 36 are preferably grooves or channels molded below a generally flat nominal surface 38 which contacts against the floor during use. A center 40 is solid and without a hole therein, although in an alternate arrangement a through hole may be provided at the center but some of the functional advantages may not be fully achieved.

Figure 6A:
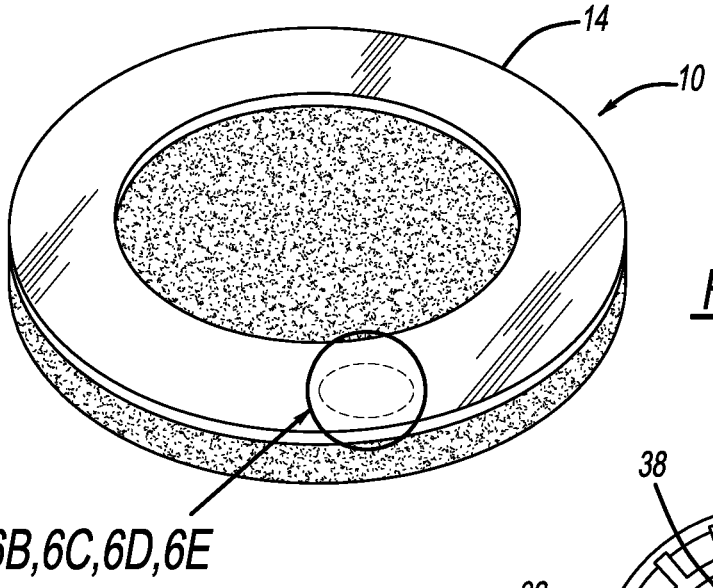
FIG. 6A is a bottom perspective view showing the ring layer and pad employed in the first embodiment pad assembly.
Figure 6B:
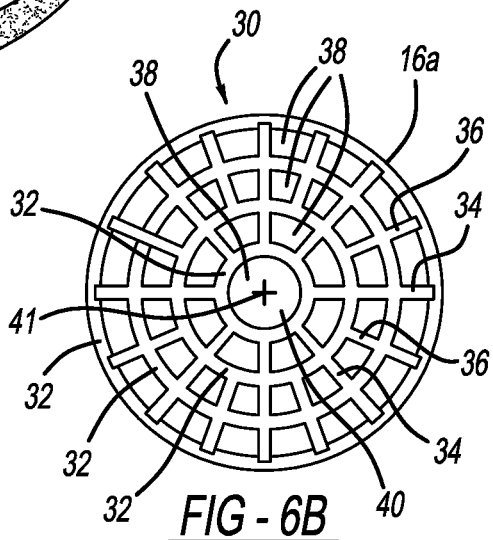
FIG. 6B is a bottom elevational view showing a disk pattern employed with the first embodiment pad assembly.
Figure 6C:
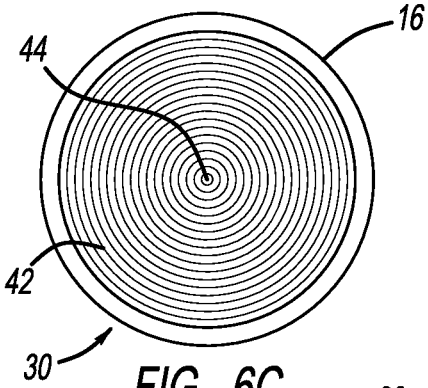
FIG. 6C is a bottom elevational view showing another disk pattern employed with the first embodiment pad assembly.

FIG. 6C shows another exemplary tool or disk 16. This embodiment employs at least 10, and more preferably at least 30 concentrically circular grooves 42 between which are raised circular ridges defining a generally flat and planar nominal surface which contacts against the building floor when in use. A center 44 is solid and without a through hole, although it is alternately envisioned that a small through hole may be provided but some of the functional advantages may not be fully achieved.

Figure 6D:
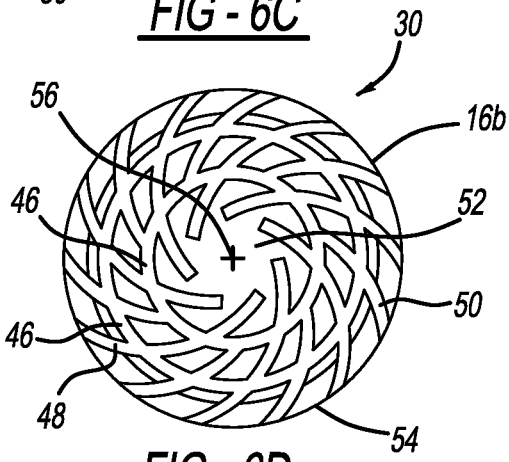
FIG. 6D is a bottom elevational view showing another disk pattern employed with the first embodiment pad assembly.

FIG. 6D illustrates yet another embodiment of tool or disk 16*b*. This exemplary embodiment provides multiple circular grooves 46, arranged in a concentric pattern. At least 4 and more preferably 7 arcuately curved spokes 48, of an elongated nature, and at least 4 and more preferably 7, arcuately curved shortened spokes 50 intersect circular grooves 46. Spokes 48 and 50 are channels or grooves which outwardly radiate between a solid center 52 and a circular tapered periphery 54 of disk 16*b*. Innermost ends of spokes 48 and 50 are offset from a disk centerline 56. Alternately, a central through hole may be provided at center 52 but some of the functional benefits may not be fully realized.

Figure 6E:
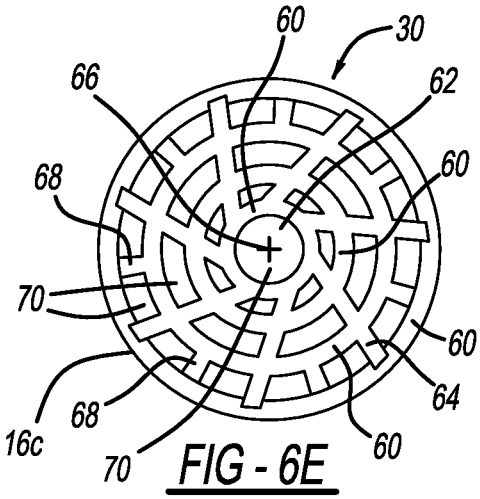
FIG. 6E is a bottom elevational view showing another disk pattern employed with the first embodiment pad assembly.

Still another configuration is shown in FIG. 6E. Multiple circular grooves 60 are concentrically arranged above a solid center 62. At least 3 and more preferably 7 linearly elongated spokes 64 outwardly radiate from an innermost circular groove to a peripheral tapered circular groove, however, an innermost end of each spoke 64 is offset from a centerline 66. Additional shortened spokes 68 outwardly radiate between outermost groove and the next groove internal therefrom. The shortened spokes 68 are radially aligned with disk centerline 66.

These different disk patterns of FIGS. 6B through 6E are expected to perform differently depending upon whether polishing or grinding use is desired and also depending upon the floor materials and characteristics to be worked upon by the present pad assembly 10. For example, a liquid polishing or grinding solution is typically employed between the disks and the floor. Therefore, the angle, size, spacing and curvature of the channels or grooves somewhat dictates the flow of the solution and abrasive action between the disks and floor when the pad assembly is being rotated by the powered machine. Moreover, these pattern characteristics also assist the pads in riding over, or alternately abrading, floor surface imperfections such as localized bumps or ridges therein. It should also be appreciated that polishing or grinding pastes or powders may alternately be employed instead of liquid solutions. Additionally, any of the patterns of FIGS. 6B-6E may have an offset angle $\alpha$ or have a parallel planar relationship $\beta$, or may be used with any of the embodiments disclosed herein. Notwithstanding, these pattern shapes also have an ornamental aspect.

Figure 7:
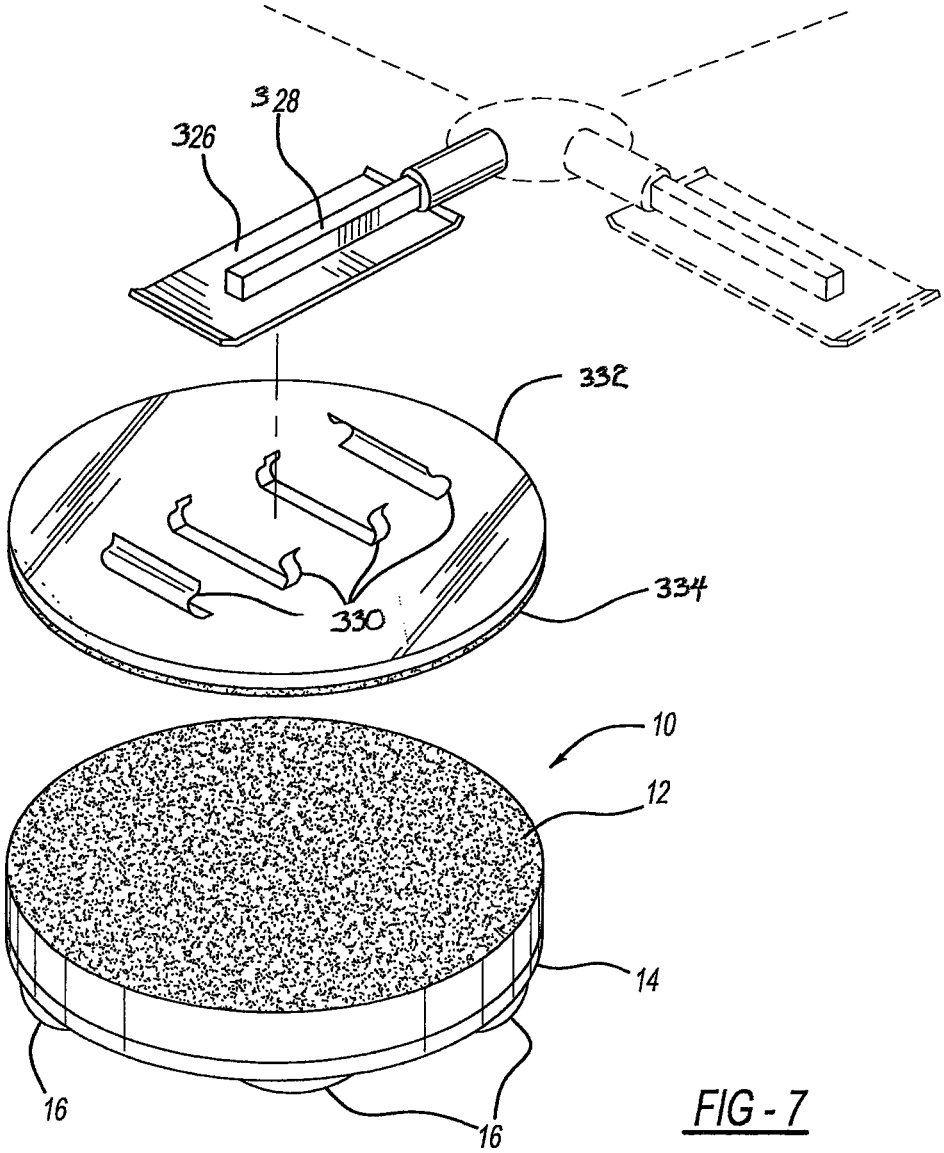
FIG. 7 is a partially exploded top perspective view showing the first embodiment pad assembly and a powered machine.
Figure 8:
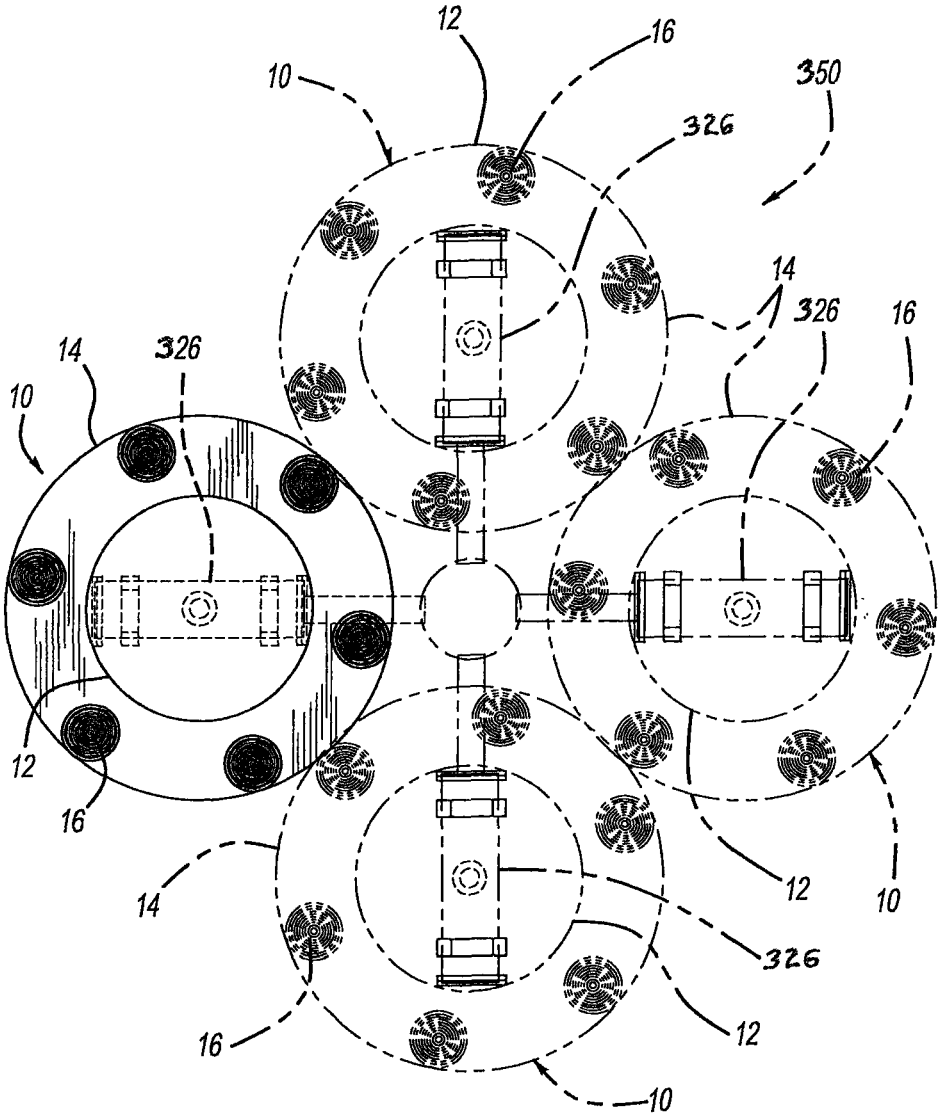
FIG. 8 is a diagrammatic bottom elevational view showing the first embodiment pad assembly and powered machine.

FIG. 7 shows an innovative way that polishing pad 10 could be secured to a paddle 326 of a rotating arm 328 of an electric motor powered floor polishing or grinding machine 350. A hard rubber or plastic disk 332 includes a plurality of clips 330 for releasably securing to paddle 326. A panel 334 of hook-and-loop-type hooks (e.g. Velcro®) may be secured to the bottom of disk 332 and can be removably secured to the fibrous base pad 12. FIG. 8 is a bottom view of machine 350, wherein a plurality of polishing pads 10 would be secured for rotation about a center axis. Alternate powered machines may be used to rotate pad assembly 10 such as those disclosed in the Background section hereinabove.

Other ways could be used to secure polishing pad 10 to machine 350. In use, reinforcement ring 14 provides a more rigid surface to which abrasive tools or disks 16 are secured than base pad 12 would provide alone. The thickness and material of reinforcement ring 14 can be varied and selected for particular applications. For example, a more rigid reinforcement ring 14 will have more of a tendency to grind a surface (such as a concrete floor) toward a planar surface, while a more flexible reinforcement ring 14 will have more of a tendency to follow contours in the surface while polishing or grinding it.

Figure 9:
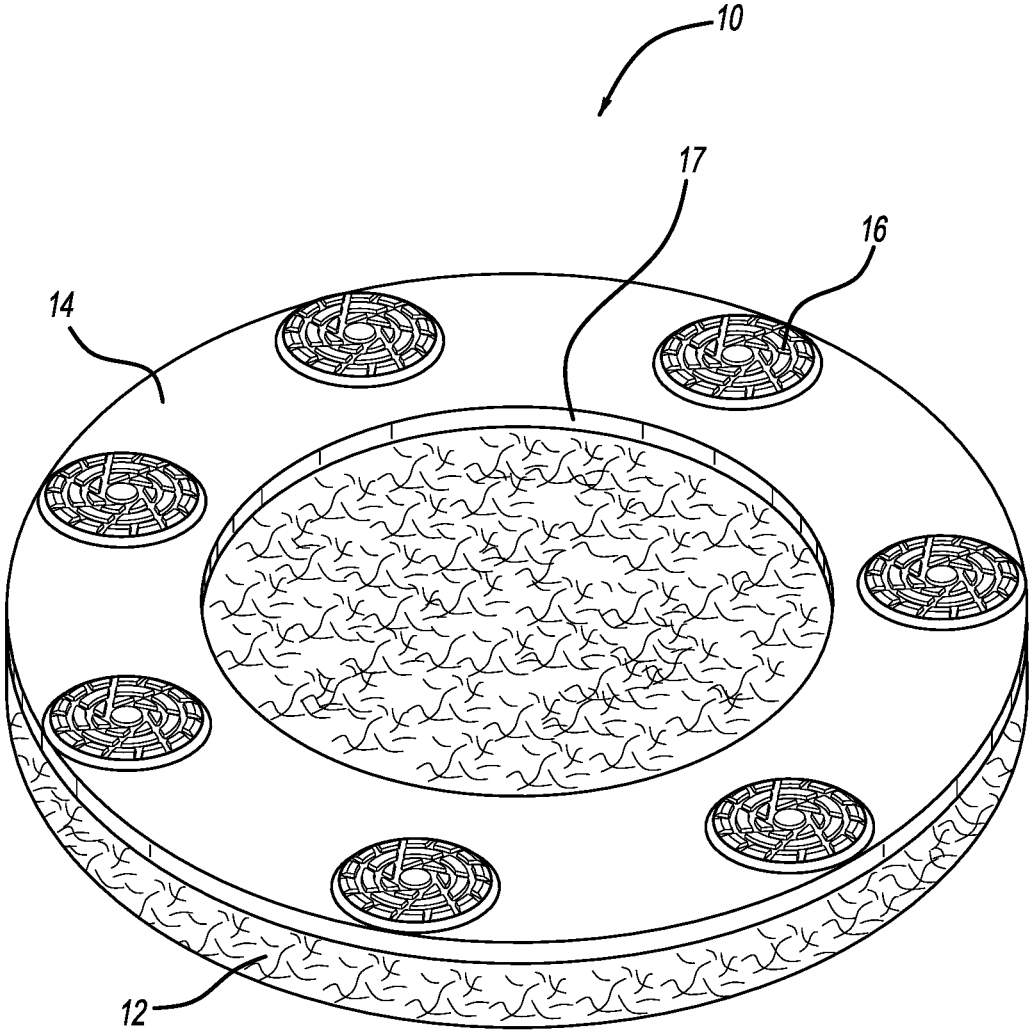
FIG. 9 is a bottom elevational view showing a second embodiment of the pad assembly.
Figure 10:
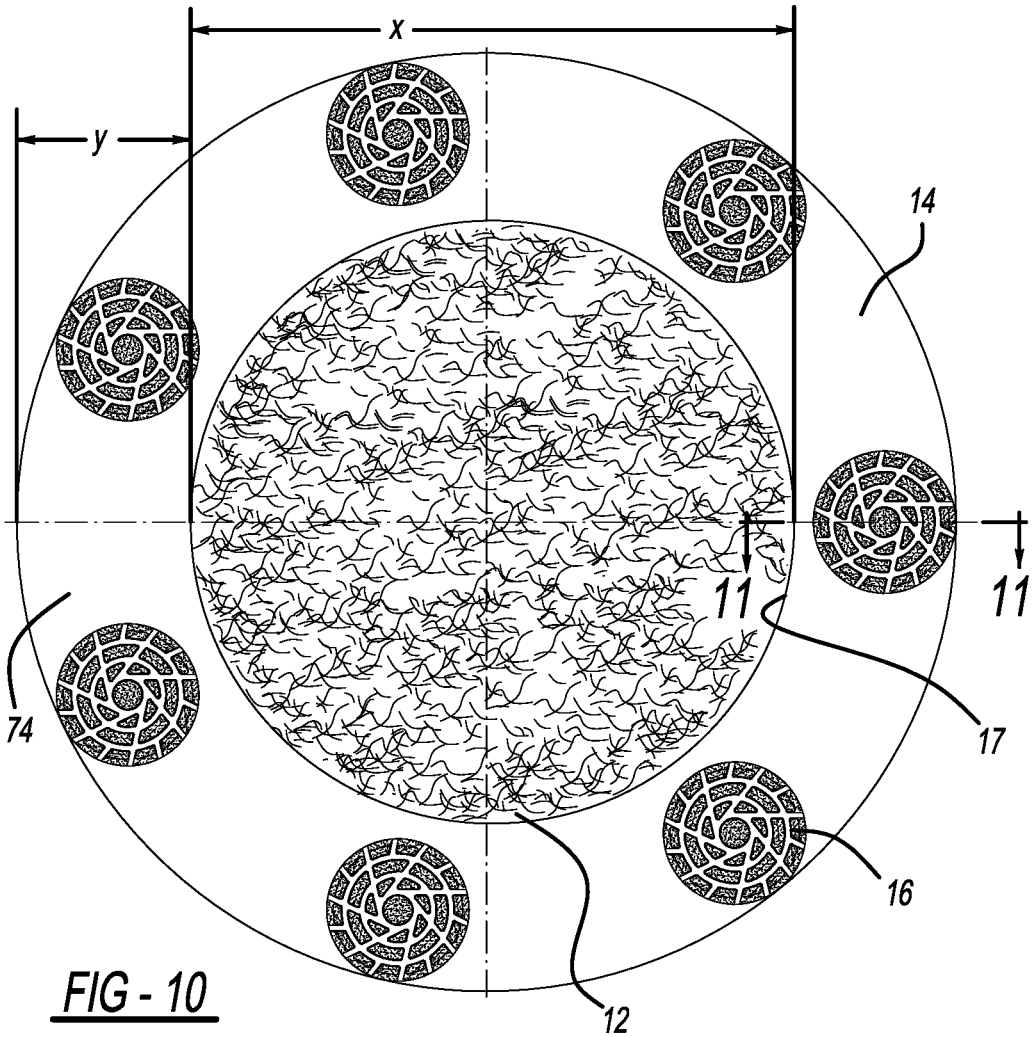
FIG. 10 is a bottom elevational view showing the second embodiment pad assembly.
Figure 11:
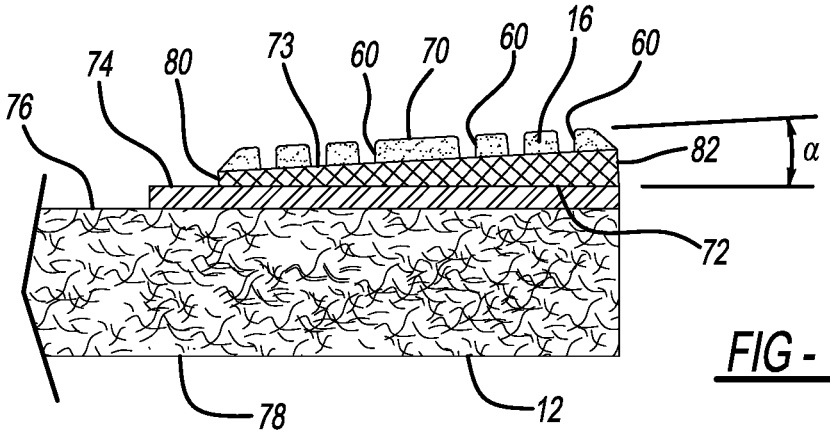
FIG. 11 is a cross-sectional view, taken along line 11-11 of FIG. 10, showing the second embodiment pad assembly.

Reference should now be made to FIGS. 9-11 for another embodiment of pad assembly 10. A fibrous circular pad 12 and elastomeric or polymeric reinforcement ring 14 are essentially as provided hereinabove. It is noteworthy that inner edge 17 defining the hole of ring 14 has a diameter or linear dimension x which is larger than a linear dimension y of a solid section of ring 14 which is adjacent to one side of the hole. More preferably, hole dimension x is at least twice as large as ring dimension y and more preferably, dimension x is 9 inches. The hole relationship of x>y is expected to improve floor contact by the fibrous central portion of pad 12 within the hole defined by internal edge 17 of ring 14. At least 4 and more preferably 7 tools or disks 16 are adhesively attached to a lower surface of reinforcement ring or layer 14. Each disk has a diameter of 1-2.5 inches and more preferably 2 inches. This disk size and quantity on pad assembly 10 is ideally suited for floor-grinding and provides improved floor contact as compared to prior constructions which used 3 inch diameter disks and were arranged in a quantity of less than 7 per pad assembly. Notwithstanding, the present dimensional relationships and the arrangement and quantity of disks about the ring also have ornamental aspects.

Each disk 16 of this embodiment has an offset angle $\alpha$ between a nominal generally flat, floor-contacting surface 70 of disk pattern 30 and an upper base surface 72 (upper when in the functional position with surface 70 against the floor). Angle $\alpha$ is at least 2 degrees, more preferably at least 2-10 degrees, or 4 degrees, and even more preferably 4-10 degrees. Surface 70 is preferably parallel to a nominal surface 73 defined by the most depressed portions of the circular and radial grooves. Upper surface 72 of the base of each disk is preferably parallel to the mating lower surface 74 of reinforcement ring 14 and also both lower and upper surfaces 76 and 78, respectively, of pad 12. An apex of angle $\alpha$ and thinnest portion is preferably adjacent an inboard edge 80 of each disc while the thickest portion of each disk 16 is preferably at an outboard edge 82. While each disk 16 is shown as being of the FIG. 6E pattern, it should be appreciated that it is alternately envisioned that the other disk patterns disclosed hereinabove may also be employed with this embodiment although all of the functional benefits may or may not be fully realized.

Figure 12:
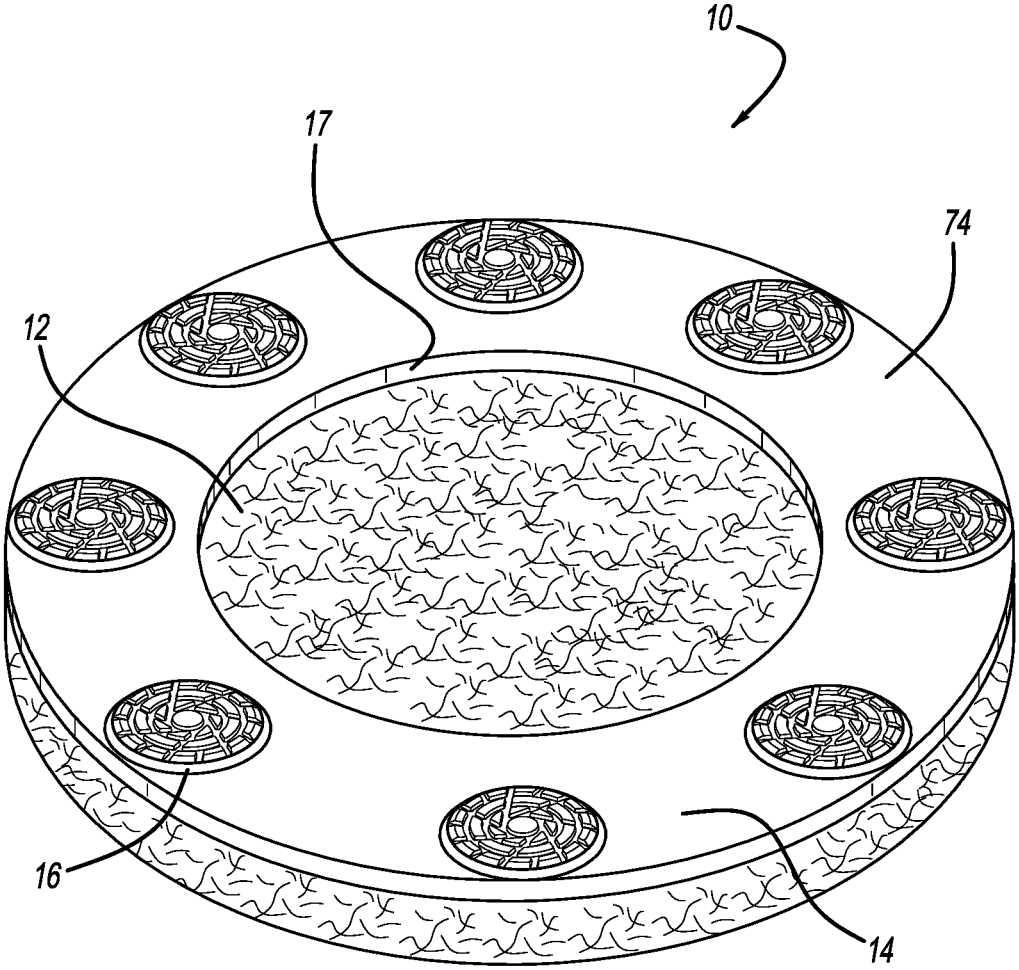
FIG. 12 is a bottom perspective view showing a third embodiment of the pad assembly.
Figure 13:
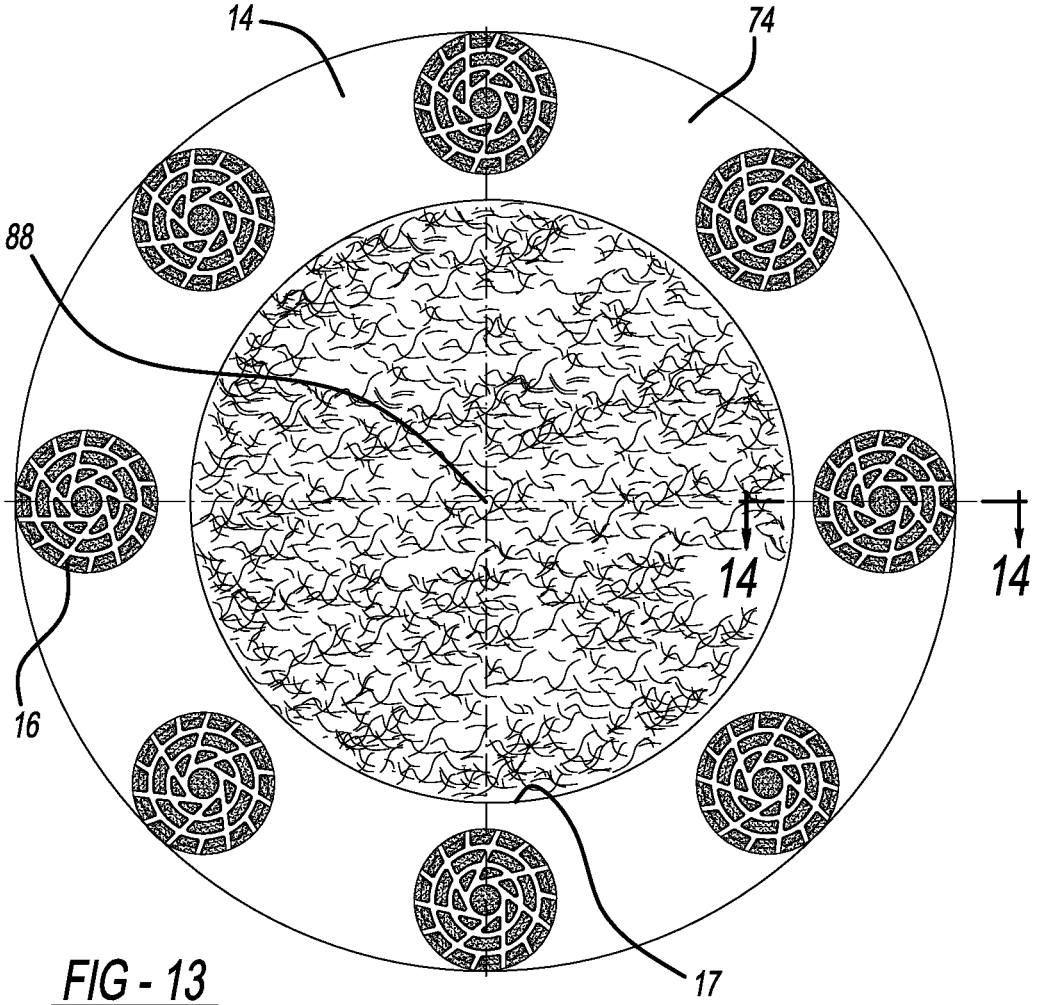
FIG. 13 is a bottom elevational view showing the third embodiment pad assembly.
Figure 14:
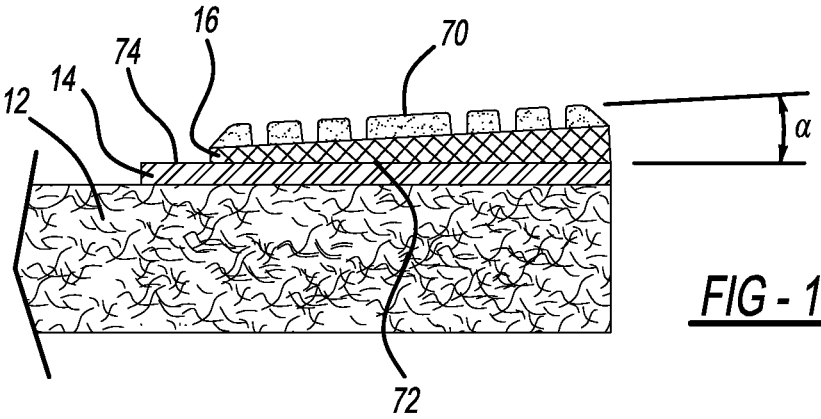
FIG. 14 is a cross-sectional view, taken along line 14-14 of FIG. 13, showing the third embodiment pad assembly.
Figure 15:
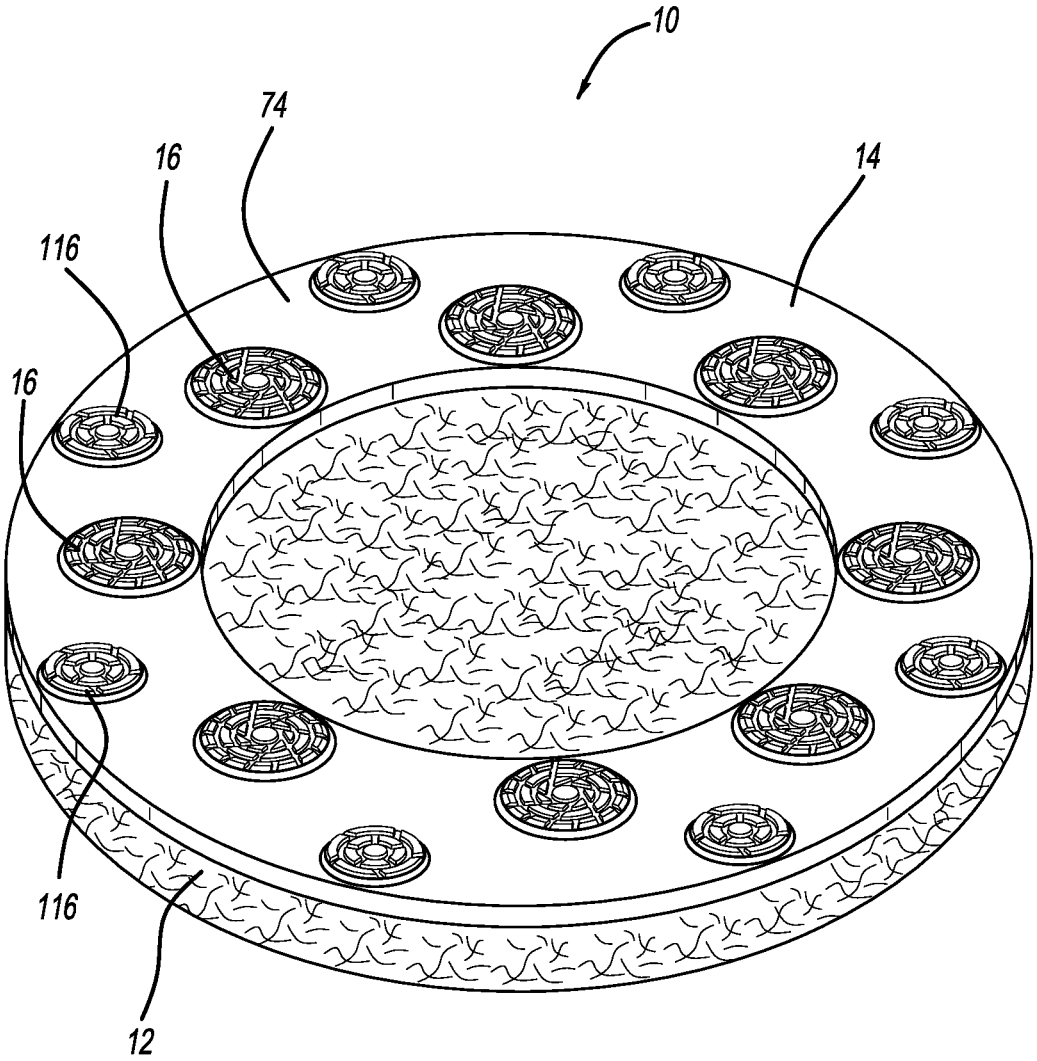
FIG. 15 is a bottom perspective view showing a fourth embodiment of the pad assembly.
Figure 16:
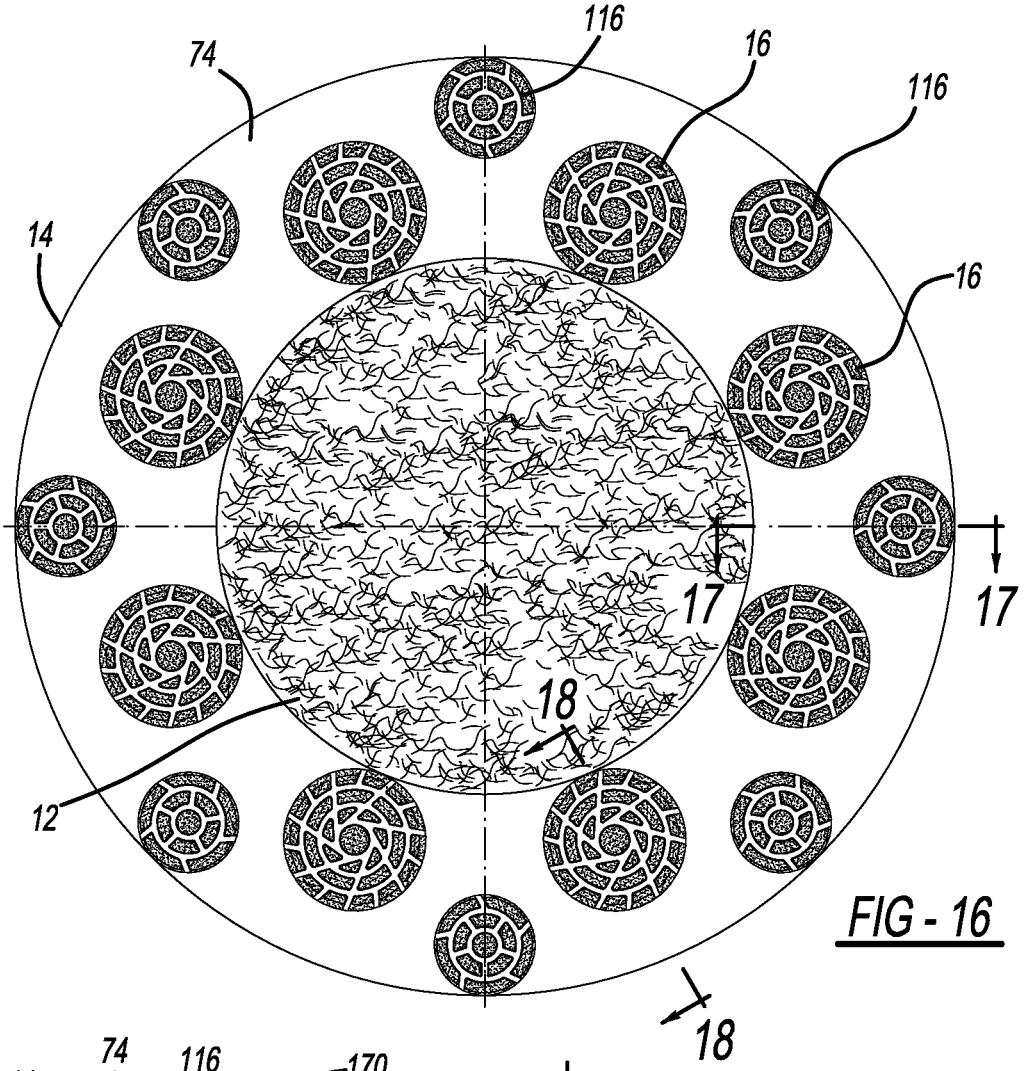
FIG. 16 is a bottom elevational view showing the fourth embodiment pad assembly.
Figure 17:
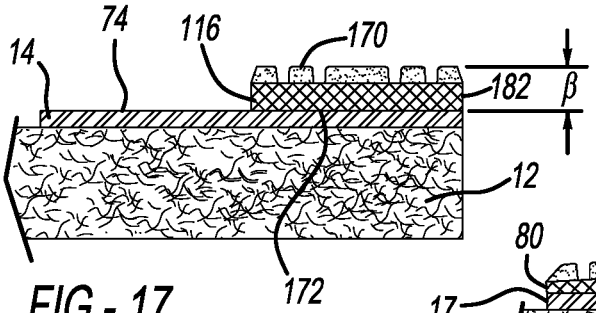
FIG. 17 is a cross-sectional view, taken along line 17-17 of FIG. 16, showing the fourth embodiment pad assembly.
Figure 18:
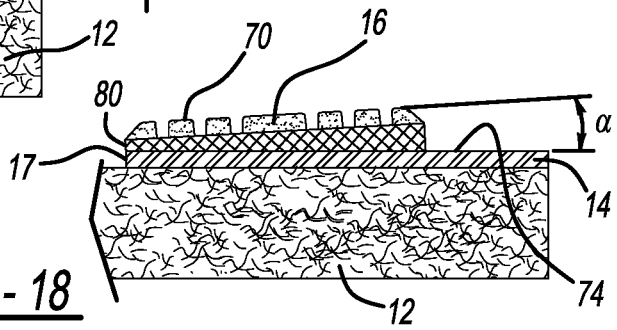
FIG. 18 is a cross-sectional view, taken along line 18-18 of FIG. 16, showing the fourth embodiment pad assembly.

FIGS. 12-14 show another embodiment of pad assembly 10. This configuration is the same as the embodiment of FIG. 9 except that there are 8 of the disks 16 mounted to lower surface 74 of reinforcement ring 14. Disks 16 are all equilaterally spaced apart from each other and are also equally spaced apart from a centerline 88 of pad 12. This configuration is ideally suited for a final polishing operation although, it should also be appreciated that there are ornamental aspects to this embodiment as well.

Referring now to FIGS. 15-18, in a further embodiment of pad assembly 10, fibrous pad 12 is essentially the same as that in the prior embodiments. A circular reinforcement ring or layer 14 is like that previously described with hole dimension x being greater than an adjacent solid side dimension y of ring 14. However, hole dimension x is at least 8 inches, preferably exactly 8 inches, while y dimension is at least 6 inches, and more preferably exactly 6 inches.

Two sets of tools or disks 16 and 116 are adhesively attached to lower surface 74 of reinforcement ring 14. The disk sets have differing characteristics from each other, such as size, pattern, angles, grit coarseness, material composition, or the like. Furthermore, the first set of disks 16 are radially offset from and circumferentially alternating with the second set of disks 116.

Inner first set of disks 16 each have a diameter of 2 inches and an angle $\alpha$ of 2-10 degrees, more preferably at least 4 degrees. An innermost edge 80 of each disc 16 is generally aligned with inner edge 17 of ring 14. Conversely, each of the outer second set of disks has its nominal floor-contacting surface or plane 170 at a dimensional relationship or zero angle $\beta$ generally parallel to a top surface 172 of its base which is also parallel to lower surface 74 of ring 14 and the top and bottom surfaces of fibrous pad 12. An outermost edge 182 of each of the second disks 116 is generally aligned with the peripheral surfaces of ring 14 and fibrous pad 12. Moreover, each second disk 116 has a diameter less than that of first disk 16, and more preferably 1.5 inches.

The angle $\alpha$ of disks 16 (of both this and the other offset angled embodiments disclosed herein) compensates for the inherent uneven wear that occurs when the powered machine rotates pad assembly 10 while the machine also tends to provide more downward force closer to the centerline than at the peripheral portions of the pad assembly. This is expected to improve longevity and polishing/grinding consistency when in use. Furthermore, the disk and ring configurations of the FIG. 15-18 embodiment are ideally suited for a pre-polishing step between grinding and polishing, although certain ornamental aspects of this construction are also achieved.

Figure 19:
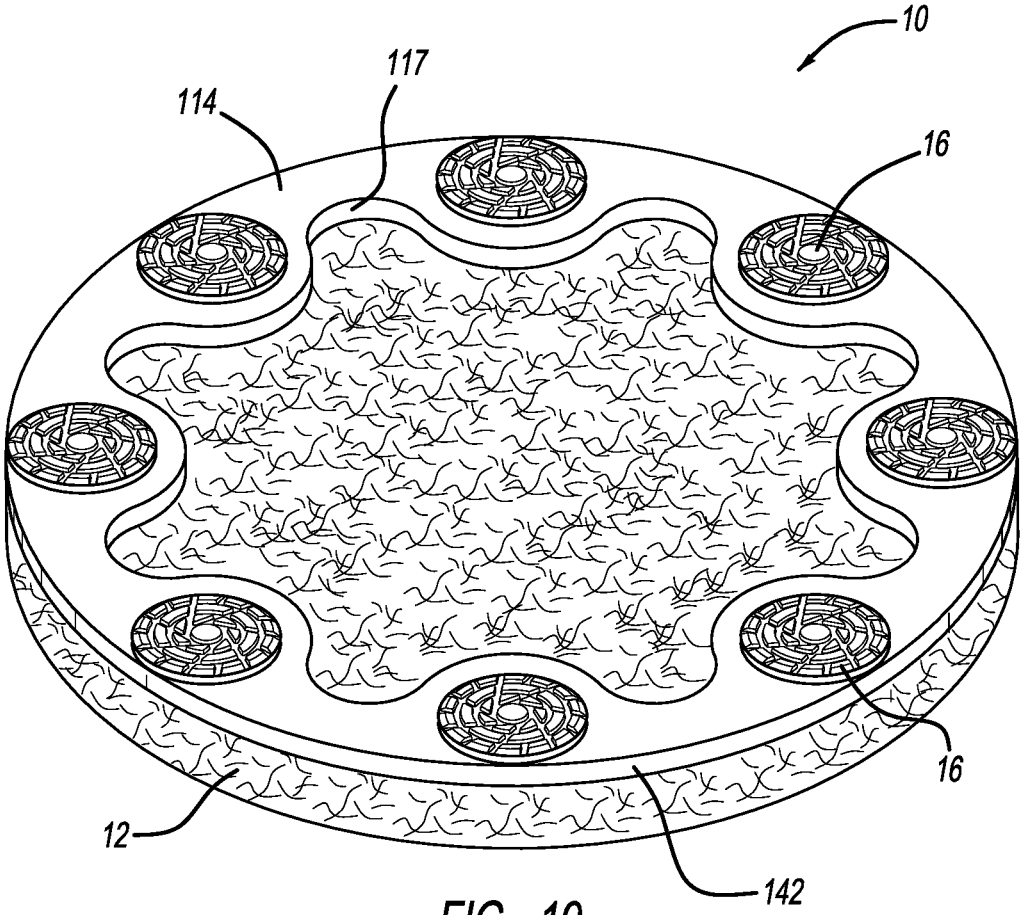
FIG. 19 is a bottom perspective view showing a fifth embodiment of the pad assembly.
Figure 21:
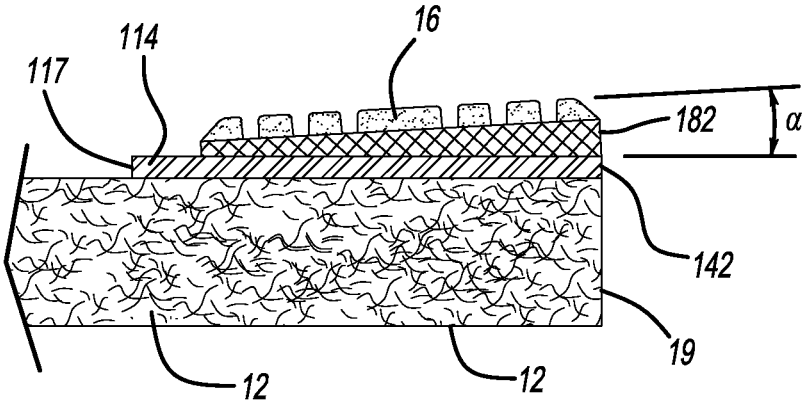
FIG. 21 is a cross-sectional view, taken along line 21-21 of FIG. 20, showing the fifth embodiment pad assembly.
Figure 20:
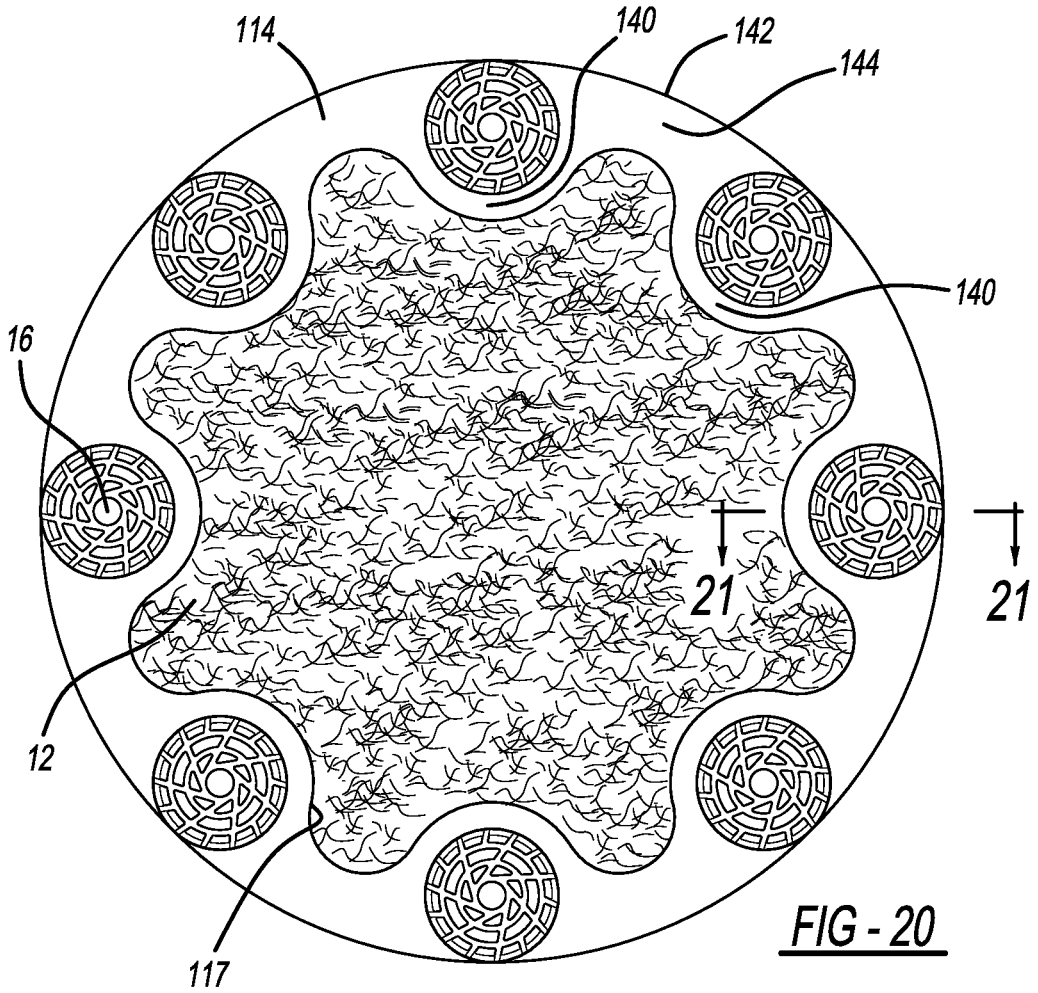
FIG. 20 is a bottom elevational view showing the fifth embodiment pad assembly.
Figure 22:
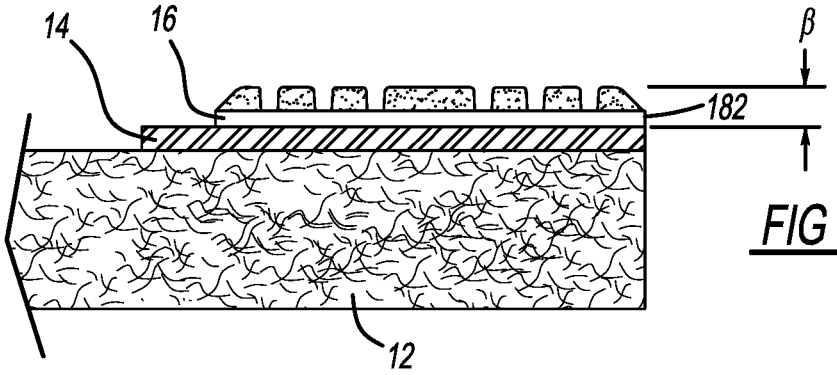
FIG. 22 is a cross-sectional view, like that of FIG. 21, showing a sixth embodiment of the pad assembly.

Reference is now made to FIGS. 19-21. This exemplary embodiment employs a fibrous pad 12 and disks 16 like that of FIG. 13. A reinforcement ring or layer 114, however, has a wavy or undulating inner edge 117 defining a hole therein to expose a central portion of fibrous pad 12. Ring 114 has peaks 140, with a greater radial distance between an outer peripheral edge 142 and inner edge 117 of ring 114. Spaced between adjacent peaks 140 are valleys 144 where the radial dimension or thickness is less between outer peripheral edge 142 and inner edge 117 of ring 114. This wavy or undulating ring shape maximizes the center hole area, and thereby floor-to-fibrous pad contact. The hole is essentially surrounded by the abrading tools or disks 16. Nevertheless, there are also ornamental aspects to this design. While the bottom or working disk nominal surface-to-ring and pad angle $\alpha$ is preferably offset angled by 2-10 degrees, and more preferably at least 4 degrees, (see FIG. 21), it is alternately envisioned in FIG. 22 that such could be given a parallel planar relationship of $\beta$ instead although some of the functional advantages may not be realized. Both of the FIGS. 21 and 22 configurations have the outermost peripheral edge 182 of each disk 16 substantially aligned with peripheral edges 142 of ring 114 and 146 of pad 12.

While various embodiments have been disclosed, it should be appreciated that additional variations of the pad assembly are also envisioned. For example, while preferred dimensions have been disclosed hereinabove, it should alternately be appreciated that other dimensions may be employed; for example a peripheral pad diameter of at least 10 inches may be employed and disk diameters of 0.5-2.5 inches may also be employed. Moreover, circular peripheral shapes for the pad, reinforcement ring and disks are preferred, however, other arcuate or even generally polygonal peripheral shapes may be used although certain of the present advantages may not be fully realized. While certain materials have been disclosed it should be appreciated that alternate materials may be used although all of the present advantages may not be fully achieved. It is also noteworthy that any of the preceding features may be interchanged and intermixed with any of the others; by way of example and not limitation, any of the disclosed reinforcement ring shapes and/or sizes may be employed with or without angular disks, with any of the aforementioned disk patterns and/or with any of the disk-to-disk positioning. Accordingly, any and/or all of the dependent claims may depend from all of their preceding claims and may be combined together in any combination. By way of further example, any of the previously disclosed disk patterns may be employed with or without offset angular disk surfaces and/or with any of the disk-to-disk positioning. Variations are not to be regarded as a departure from the present disclosure, and all such modifications are entitled to be included within the scope and sprit of the present invention.

The invention claimed is:

1. A pad assembly comprising:

(a) a fibrous and flexible pad including an upper surface, a floor-facing lower surface and a circular peripheral surface, the floor-facing lower surface being entirely flat, and the pad including diamond particles;

(b) a reinforcement layer attached to the floor-facing surface of the pad, the reinforcement layer including an internal edge defining a hole therethough, and the reinforcement layer being flexible but stiffer than the pad;

(c) abrasive tools attached to a floor-facing surface of the reinforcement layer, the abrasive tools including diamond particles, and the abrasive tools being spaced apart from each other; and (d) a central, porous and fibrous area of the floor-facing lower surface of the pad being exposed through the hole of the reinforcement layer such that a linear dimension X of the central area within the hole is greater than a linear dimension Y of one side of the reinforcement layer between the hole and a periphery thereof, and the upper surface of the pad at the central area being attachable to a free-standing powered floor polishing or grinding machine.

2. The pad assembly of claim 1 wherein:

the periphery of the reinforcement layer is circular and substantially aligned with the peripheral surface of the pad;

the abrasive tools are all substantially equally spaced away from a centerline of the pad;

there are at least six of the abrasive tools attached to the reinforcement layer; and the hole dimension X is at least twice as large as the reinforcement dimension Y so that the center area of the pad contacts a floor during floor polishing or grinding.

3. The pad assembly of claim 1, wherein the internal edge of the reinforcement layer is circular such that the reinforcement layer has a ring shape, and the reinforcement layer has thickness of 0.125 inch or less which is thinner than a thickness of the fibrous pad.

4. The pad assembly of claim 1, wherein:

the internal edge of the reinforcement layer has an arcuately wavy shape including peaks and valleys;

the reinforcement layer being linearly larger at the peaks than at the valleys;

one of the abrasive tools is located within each of the peaks; and the central area of the floor-facing lower surface of the pad is exposed through the hole of the flexible reinforcement layer.

5. The pad assembly of claim 1, further comprising clip fasteners coupled to the top surface of the pad adapted for removable attachment to paddles of a rotating floor polishing or grinding machine.

6. A pad assembly comprising:

(a) a flexible pad including a floor-facing lower surface;

(b) a reinforcement layer attached to the floor-facing lower surface of the pad, the reinforcement layer including an internal edge defining a hole therethough;

(c) abrasive tools attached to a floor-facing surface of the reinforcement layer; and (d) a central area of the pad being exposed through the hole of the reinforcement layer such that a linear dimension of the central area within the hole is greater than an adjacent width dimension of one side of the reinforcement layer, and the central area of the pad being located at a rotational centerline of the pad and the reinforcement layer.

7. The pad assembly of claim 6, wherein:

a peripheral surface of the pad is circular;

the pad is fibrous and porous at the floor-facing lower surface thereof;

the periphery of the reinforcement layer is circular and substantially aligned with the peripheral surface of the pad; and the tools are circular disks which are all substantially equally spaced away from a centerline of the pad.

8. The pad assembly of claim 7, wherein there are at least eight of the disks attached to the reinforcement layer.

9. The pad assembly of claim 6, wherein each of the tools has a floor-contacting nominal surface which is angularly offset by at least two degrees relative to the bottom surface of the reinforcement layer, and an innermost edge and apex of each of the tools faces toward the rotational centerline of the pad.

10. The pad assembly of claim 6, wherein each tool is a circular disk, and at least some of the tools on opposite sides of the rotational centerline of the pad have a floor-contacting nominal surface which is angularly offset by at least four degrees relative to the bottom surface of the reinforcement layer with an innermost edge and apex facing toward the rotational centerline of the pad.

11. The pad assembly of claim 6, wherein the internal edge of the reinforcement layer is circular such that the reinforcement layer has a ring shape, and the floor-facing lower surface of the pad is entirely planar.

12. The pad assembly of claim 6, wherein:

the internal edge of the reinforcement layer has an arcuately wavy shape including peaks and valleys;

the reinforcement layer being linearly larger at the peaks than at the valleys;

one of the tools is located within each of the peaks; and the floor-facing surface of the central area of the pad is exposed and contactable with a floor during rotation, through a hole defined by the wavy internal edge of the reinforcement layer.

13. The pad assembly of claim 6, wherein at least one of the tools has a circular periphery and includes a floor-abrading surface including arcuate channels outwardly radiating between a centerline and periphery of the tool, the pattern further including circular channels intersecting the curved and radiating channels, the tool including a solid center without an aperture therein, and the tools all including a polymeric material which is adhesively bonded to the reinforcement layer.

14. The pad assembly of claim 6, wherein at least one of the tools includes a floor-abrading pattern including at least ten concentric circles, with all of the tools adhesively bonded to the reinforcement layer.

15. The pad assembly of claim 6, further comprising fasteners coupled to the top surface of the pad adapted for removable attachment to paddles of a rotating floor polishing or grinding machine.

16. The pad assembly of claim 6, being a machine-powered floor polishing pad assembly.

17. The pad assembly of claim 6, being a machine-powered floor grinding pad assembly.

18. The pad assembly of claim 6, wherein the tools each have a circular periphery and further comprise a first set each of which is larger in diameter than a diameter of a second set, and the tools of the first set alternating with or being offset from the tools of the second set.

19. A pad assembly comprising:

(a) a flexible pad including a floor-facing surface and an exposed circular peripheral surface;

(b) a reinforcement ring attached to the floor-facing surface of the pad, the reinforcement ring including a circular periphery, the reinforcement ring being thinner than the pad with a ring-to-pad thickness ratio no greater than 0.125 to 1.0, and the reinforcement ring being flexible but stiffer than the pad;

(c) at least three abrasive tools attached to a floor-facing surface of the reinforcement ring, and the abrasive tools being spaced apart from each other;

(d) the pad assembly being a machine-rotatable floor polishing or grinding pad assembly adapted for use with a liquid or paste polishing or grinding material; and (e) a section of the pad being contactable with a floor through a hole in the reinforcement ring when polishing or grinding the floor.

20. The pad assembly of claim 19, wherein:

the pad is fibrous;

the periphery of the reinforcement ring is substantially aligned with the peripheral surface of the pad;

the tools are circular disks which are all substantially equally spaced away from a centerline of the pad; and at least one of the disks are located closer to an internal edge of the reinforcement ring than to the periphery of the reinforcement ring.

21. The pad assembly of claim 19, wherein there are at least eight of the tools attached to the reinforcement ring with at least one of the tools comprising outwardly radiating spokes having innermost ends angularly offset from a tool centerline.

22. The pad assembly of claim 19, wherein at least multiple of the tools on opposite sides of the rotational centerline of the pad have a floor-contacting nominal surface which is angularly offset by at least two degrees relative to the bottom surface of the reinforcement ring with an innermost edge and apex facing toward a rotational centerline of the pad.

23. The pad assembly of claim 19, wherein at least multiple of the tools on opposite sides of the rotational centerline of the pad have a floor-contacting nominal surface which is angularly offset by at least four degrees relative to the bottom surface of the reinforcement ring with an apex of the angular offset facing an inboard edge of the tool.

24. The pad assembly of claim 19, further comprising an internal edge of the reinforcement ring being circular such that a portion of the pad at a rotational centerline is exposed through the hole within the reinforcement layer defined by the internal edge.

25. The pad assembly of claim 19, further comprising:

an internal edge of the reinforcement ring having an arcuately wavy shape including peaks and valleys;

the reinforcement ring being linearly larger at the peaks than at the valleys;

one of the tools being located within each of the peaks; and the section of the pad being a floor-facing central area at a rotational axis, exposed through the hole defined by the wavy internal edge of the reinforcement ring.

26. The pad assembly of claim 19, wherein at least one of the tools has a circular periphery and includes a floor-abrading surface including arcuate channels outwardly radiating between a centerline and periphery of the tool, the pattern further including circular channels intersecting the curved and radiating channels, the tool including a solid center without an aperture therein, and the tools all including a polymeric material.

27. The pad assembly of claim 19, further comprising clip fasteners coupled to a top surface of the pad adapted for removable attachment to paddles of a rotating floor polishing or grinding machine.

28. The pad assembly of claim 19, wherein the reinforcement ring has a thickness greater than zero and up to 0.125 inch.

29. The pad assembly of claim 19, wherein the reinforcement ring is rubber or plastic.

30. A pad assembly comprising:

(a) a flexible pad including a floor-facing surface;

(b) a flexible layer attached to the floor-facing surface of the pad by an adhesive, the layer including a central hole through which a floor-abrading central area of the pad is exposed, the layer being thinner and stiffer than the pad, and the layer being a different material than the pad;

(c) multiple floor-polishing or floor-grinding tools being spaced apart from each other and attached to a floor-facing surface of the layer;

(d) diamond particles located on at least one of: (i) the pad or (ii) at least one of the tools; and (e) mechanical fasteners coupled to a top surface of the central area of the pad, adapted for removable attachment of the pad to a rotating floor polishing or grinding machine.

* * * * *